United States Patent [19]

Kunz et al.

[11] 4,084,515

[45] Apr. 18, 1978

[54] LOCKING MECHANISM FOR HOPPER DOOR ACTUATOR ASSEMBLY

[75] Inventors: Andrew M. Kunz, Dolton; Donald B. Yates, Park Forest, both of Ill.; Richard L. Tuck, Highland, Ind.

[73] Assignee: Pullman Incorporated, Chicago, Ill.

[21] Appl. No.: 723,862

[22] Filed: Sep. 16, 1976

[51] Int. Cl.[2] ..... F15B 15/26; B61D 7/28

[52] U.S. Cl. ..... 105/240; 92/14

[58] Field of Search ..... 105/240, 310; 92/14

[56] References Cited

U.S. PATENT DOCUMENTS

| | | | |
|---|---|---|---|
| 2,893,327 | 7/1959 | Lunde | 105/240 |
| 3,710,729 | 1/1973 | Schuller | 105/240 |
| 3,772,996 | 11/1973 | Schuller | 105/240 |

*Primary Examiner*—Robert G. Sheridan

*Attorney, Agent, or Firm*—Thomas G. Anderson

[57] ABSTRACT

An automatic device for locking and unlocking a hopper door operating mechanism which prevents accidental opening of the hopper doors due to car oscillations and provides a protective lock while the car is in transit but which has a novel lock which is releasable by intuitional actuation of the operating mechanism.

10 Claims, 9 Drawing Figures

LOCKING MECHANISM FOR HOPPER DOOR ACTUATOR ASSEMBLY

BACKGROUND OF THE INVENTION

1. Description of the Prior Art

Various arrangements have been heretofore used in the subject environment. For example, U.S. Pat. Nos. 3,710,729 and 3,772,996, both assigned to Pullman Incorporated, employ cammed interlocks and are useful for various applications. However, they are complex and require exceptional precision in the making, assembly and operation and are not exceptionally durable.

SUMMARY OF THE INVENTION

This invention is directed to a novel and effective locking mechanism particularly adaptable for locking the piston of the cylinder for the door operating linkage.

A specific object is to provide a novel positive locking mechanism in which a pin carried by a locking lever drops behind a pair of locking ears which are carried by a drive lever of the door operating linkage, the piston rod also carrying a cam which engages with a cam surface on the underedge of the locking lever so constructed that as the rod extends a predetermined distance it lifts the locking lever and disengages the pin from the ears during a lost motion period and thereafter the rod is free to actuate the operating lever.

Of particular importance is the interrelationship between the cam and the cam edge of the locking lever and the portion of the locking ears and the vertical locking surfaces thereon and the location of the transverse pin on the outer end of the locking lever which is downwardly biased to an engaging position of the pin with the locking edges and after release of importance is the provision of camming surfaces on the back edges of the ears such that when the rod retracts the pin cams the locking lever upwardly against the spring bias over the ears whereupon the pin drops behind the ears to a locking position.

The invention contemplates the provision of a positive locking device which will not allow the piston to extend without intuitional pressurization of the cylinder so that accidental unlatching is not possible under any circumstances.

These and other objects and advantages inherent in and incompassed by the invention will become readily apparent from the specification and drawings, wherein.

DESCRIPTION OF THE INVENTION

Figure 1:
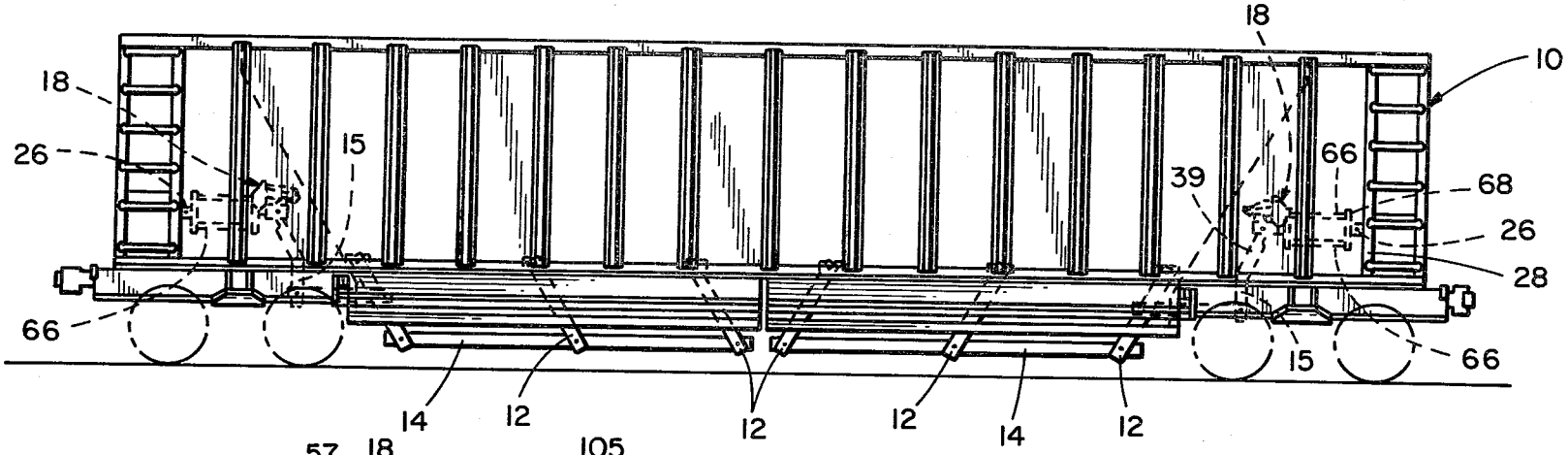
FIG. 1 is a side elevational view of a conventional hopper car and door operating mechanism with the novel latching mechanism incorporated therein.

With reference to the drawings, there is shown a hopper car 10 with hopper doors 12 pivotally mounted thereon and operated by a lever linkage 14 which is connected to a drive lever 15. It will be understood that the weight of the levers and the to and fro oscillations of the car have a tendency to cause the linkage to open the doors accidentally.

The invention directed to a novel locking mechanism 18 for securing the piston of the operating pneumatic piston and cylinder assembly 20 and thus the operating linkage. The locking mechanism 18 comprises a furcation 22 which is connected to the free or distal end of the piston rod or linearly operable draw member 24 which has a piston (not shown) at its inner end operating within a cylinder 25 which is mounted at 26 to the frame structure 28 of the railway car.

The furcation is U-shaped having a pair of laterally spaced side walls 30, 30 and an intervening light web or wall 32 which is suitably secured preferably as by welding to the outer end of the piston rod. The side walls or webs 30, 30 have laterally aligned slots 34 which are elongated axially of the rod and receive opposite ends of a pivot pin 36 therein which extends through an opening 38 in the input end 39 of the upright operating or drive lever 15. The lever 15 is pivoted intermediate its ends at 42 to adjacent framework of the railway car and is operationally connected at its lower end to the door operating linkage.

Figure 2:
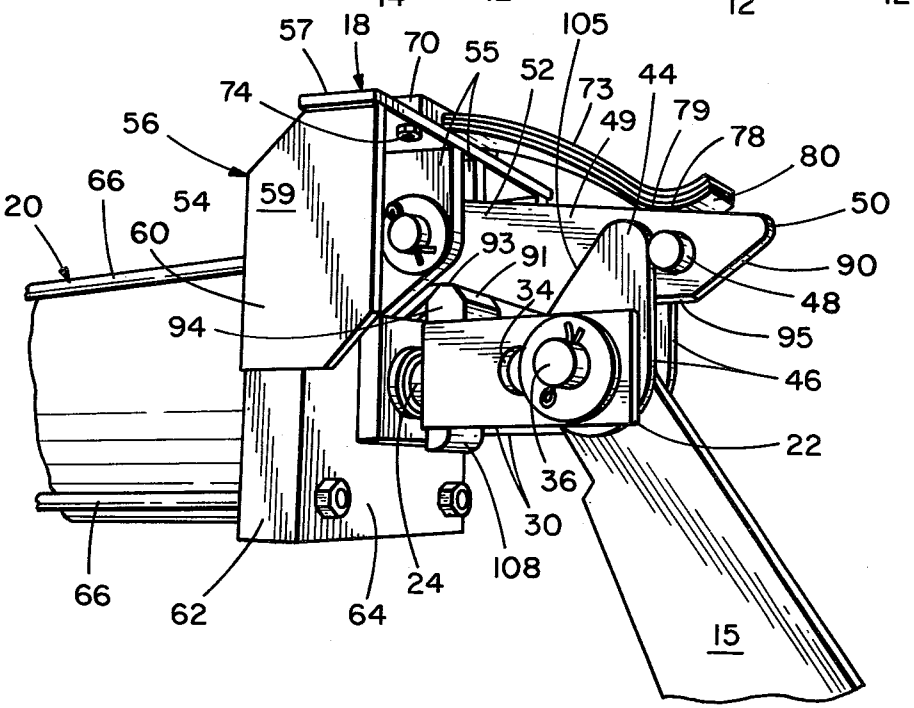
FIG. 2 is an enlarged perspective view of the latching mechanism in association with the piston and cylinder assembly.
Figure 5:
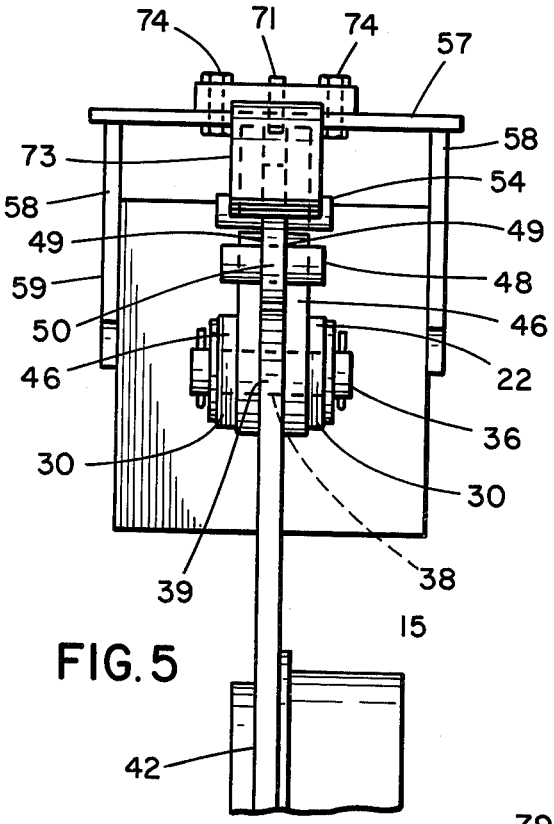
FIG. 5 is a front end view of the power cylinder and latching mechanism shown on a smaller scale.
Figure 6:
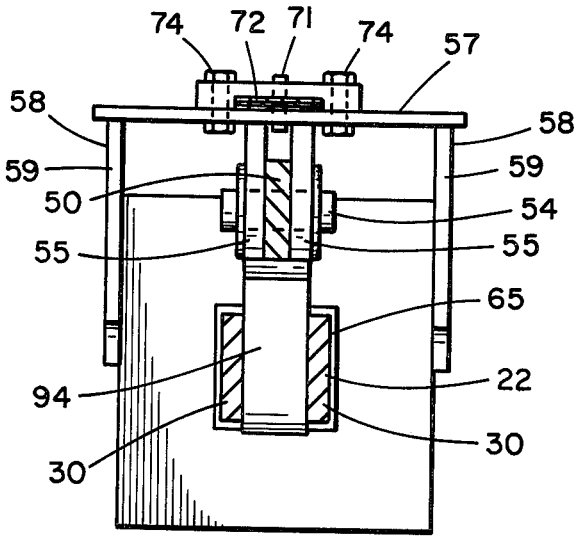
FIG. 6 is a cross-sectional view generally on line 6—6 of FIG. 3.

The upper end of the lever 15 is fastened by a pair of upstanding ears 44, 44 which are connected to the lever 15 and pivot therewith about the pivot pin 36. The ears are provided with straight locking edges 46, 46 which are positioned vertically in the locking position of the device (FIGS. 2 & 5) and provide a locking ledge for the back edge of a horizontally extending locking pin 48 which is connected to and extends from opposite sides 49, 49 of a locking lever 50 adjacent to its free end 52.

The lever 50 is pivoted on a horizontal axis at its rear end 52 on a pin 54 which is mounted through horizontally aligned openings in a pair of vertical laterally spaced mounted lugs 55, 55 which are provided within a mounting anchor or structure 56. The anchor comprises a top wall 57 connected at its ends to the upper ends 58 of a pair of vertical laterally spaced side walls 59 which at their back edges 60 are connected to side flanges 62, 62 of a vertical back plate 64. The back plate has a bushed opening 65 sleeved over the piston rod and the back plate is connected to four stay bolts 66, 66 (FIG. 2) which extends lengthwise of the cylinder 25 in embracing rotation thereto and at their rear ends are suitably connected to the back plate 68 of the cylinder which provides a rearwardly extending ear via which the cylinder is pivoted at 26 to the frame structure 28 as aforesaid.

The top wall 57 is formed with a socket 70 which admits the fixed end 72 of a leaf spring assembly 73 therein, end 72 being secured by nuts and bolt 74 connecting the socket to wall 57 and a pin 71 extending through the socket.

Figure 3:
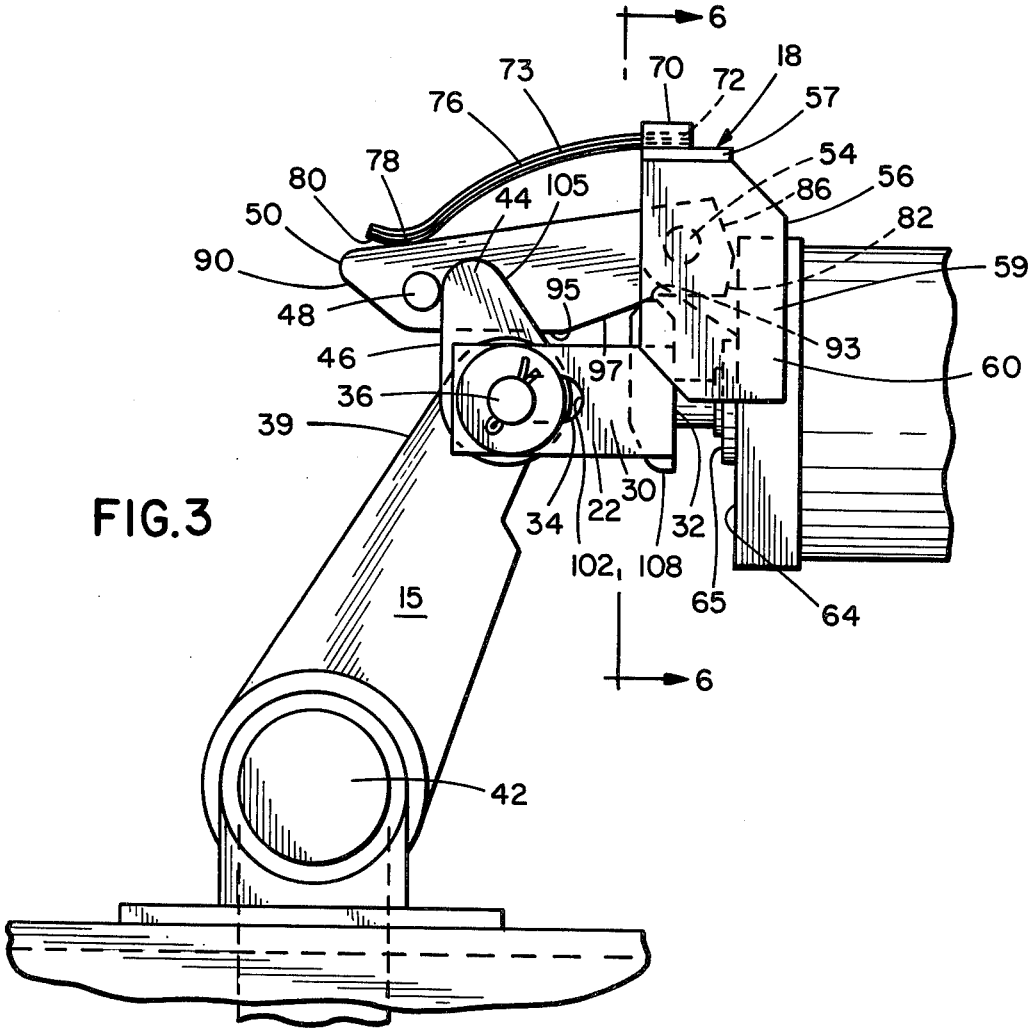
FIG. 3 is a side elevational view of the structure shown in FIG. 2.
Figure 4:
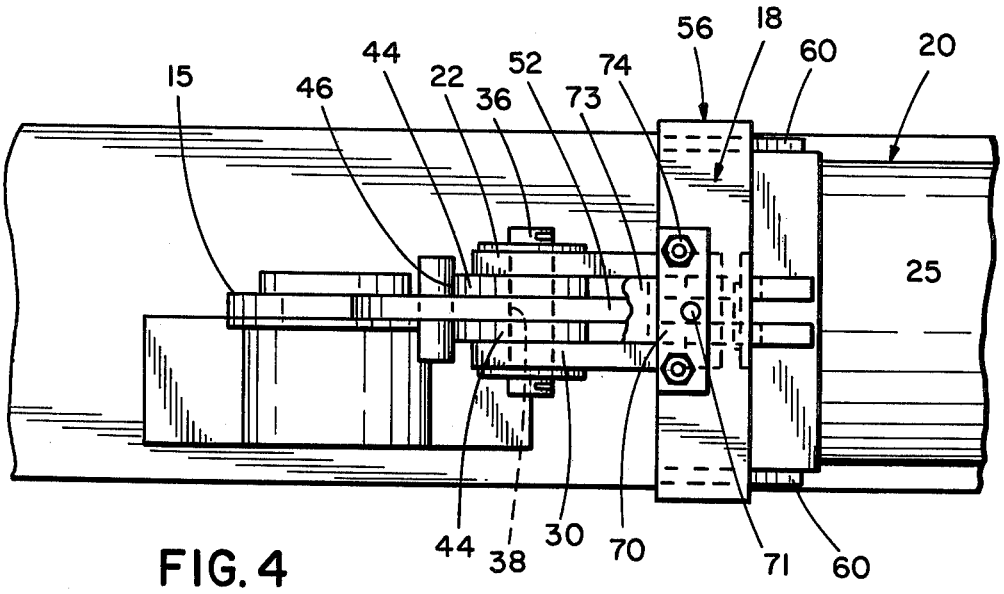
FIG. 4 is a top plan view of the structure shown in FIG. 3.
Figure 9:
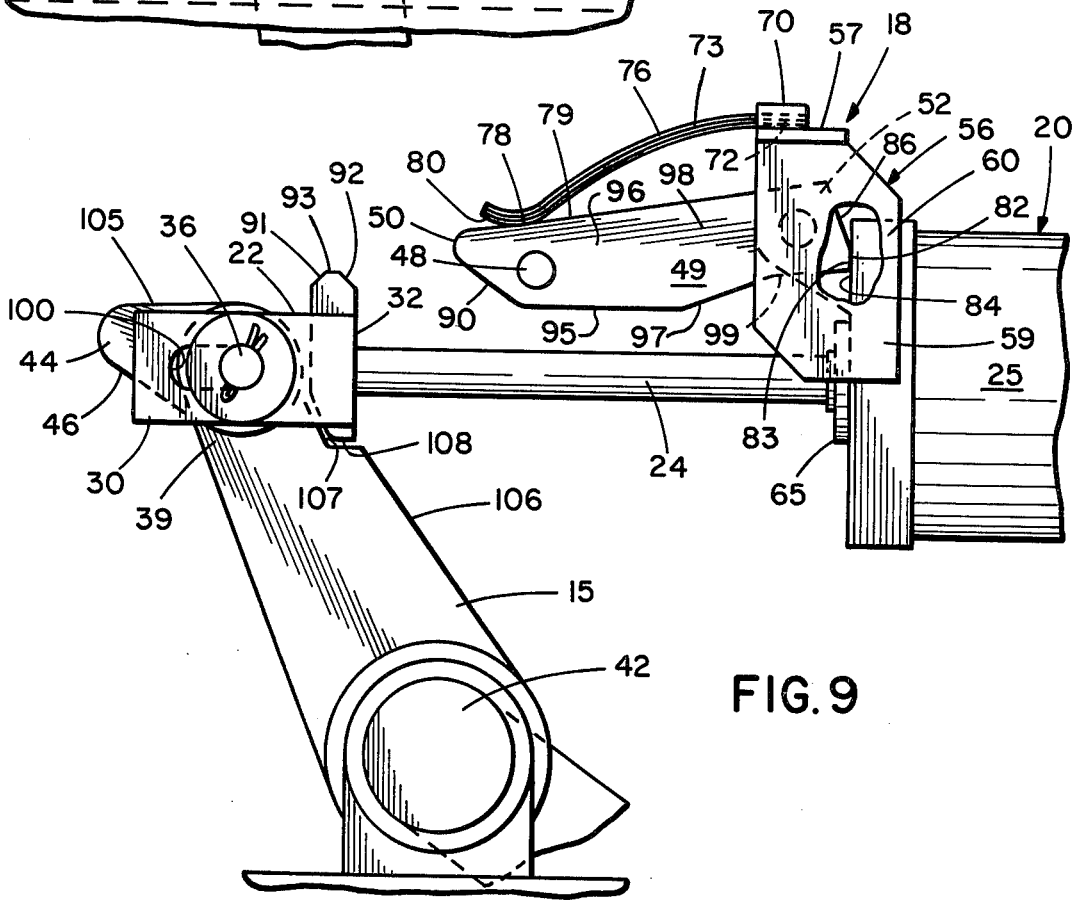
FIG. 9 is a side elevational view showing the parts unlatched.

The spring assembly 73 preferably comprises three superposed leaves which are bowed downwardly at 76 intermediate their ends from the socket and then are turned upwardly at their free end portions to provide a downwardly convexed node 78 which engages the flat straight top edge 79 of the locking lever and biases the same downwardly between the locking ears 44, 44 and the cylindrical locking element 48 in the locked position thereof. The free end of the biasing spring is turned upwardly to provide a downwardly facing cam edge 80 to permit the locking lever to float up and down between a latched position shown in FIGS. 1, 3, and 4 and an unlatched position shown in FIG. 9 whereat the piston is extended to open the hopper doors and the latching lever is in the lowermost position whereat the rear stop edge 82 thereof engages the interior vertical surface 84 of the rear anchor wall 64. It will be noted that the rear edge of the locking lever 50 has upper and lower angularly related upper and lower edges 86, 82 which converge intermediate the top and bottom of the rear edge. The lower surface 82 engages the back wall 68 and limits drooping of the lever 50 as seen in FIG. 9 disposing an upwardly and forwardly extending cam edge 90 on the forward end of lever 50 to engage a rear cam edge 92 at the upper end 92 of a locking lever lifter element 94 which extends upwardly as an extension of the rear web 32 of the furcation 22.

Figure 7:
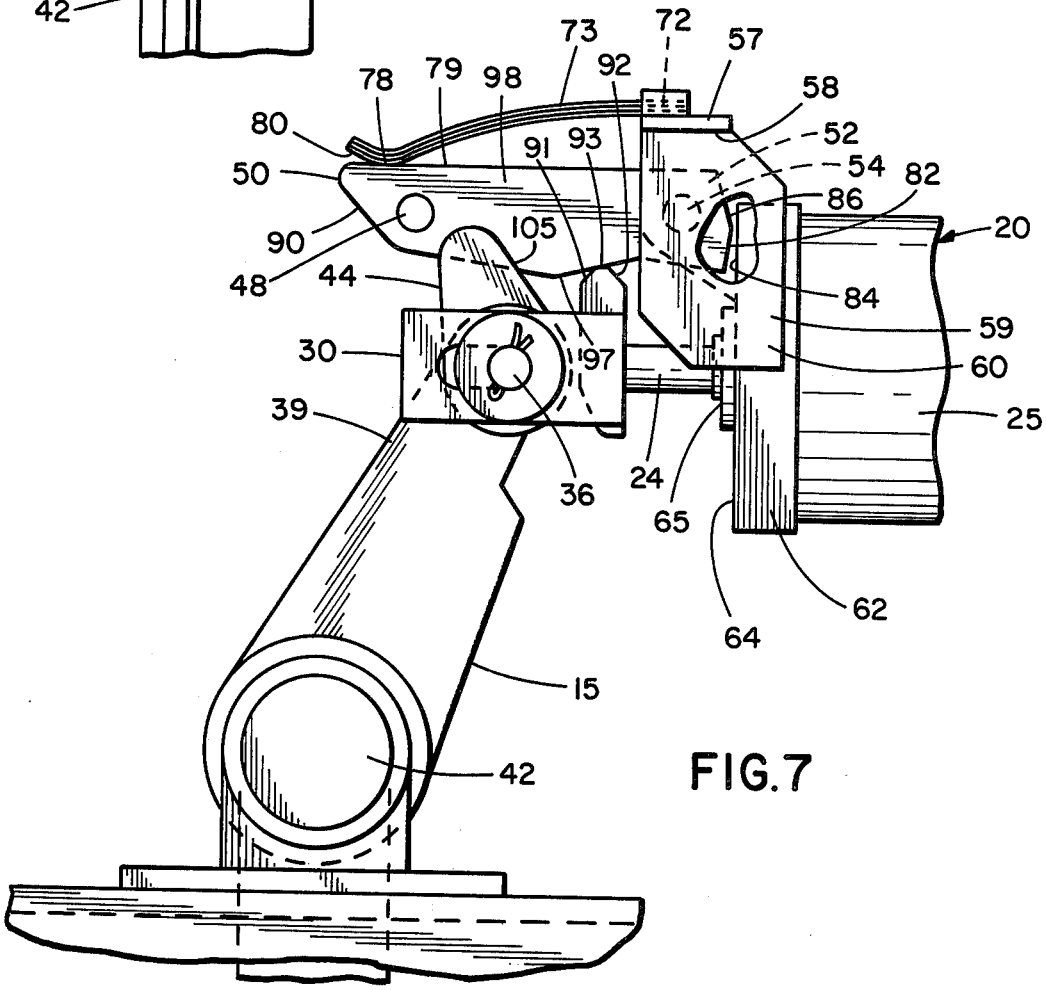
FIG. 7 is a side elevational view similar to FIG. 3 but in smaller scale showing the parts in unlatched position.

The lifter has an upper rest edge 93 and extending therefrom is a downwardly and forwardly sloping forward cam edge 91. The front cam edge 90 on the lever 50 merges at its lower rear end with the front end of a rearwardly slightly downwardly sloping lifting cam edge 95 on the forward part 96 of the lower portion of the locking lever 50. The edge 95 terminates intermediate the ends of the lever 50 and thereat merges into an upwardly and rearwardly sloping cam profile 97 on the intermediate portion 98 of lever 50 which permits the locking lever to rise as the piston is extended to clear the locking pin 48 as seen in FIG. 7 and also permits the lever 50 to lower between the ears 46 and the pin 48 to drop behind the ears when the lifting cam moves rearwardly of the lifting cam edge 95 during retraction whereat the top edge 93 of the lifter slides and bears against and provides a seat for the flat bottom profile 97 on the lower edge of the rear portion 52 of the locking lever 50 when the locking pin 48 is disposed behind the locking ears on the locking lever 50 and is held in such position by the spring. In this position the operating lever pivot pin 36 is positioned against the ends of the lost-motion slots 34 whereas in the door open position pin 36 is positioned against the inner ends 102 of slot 34 (See FIG. 9).

Figure 8:
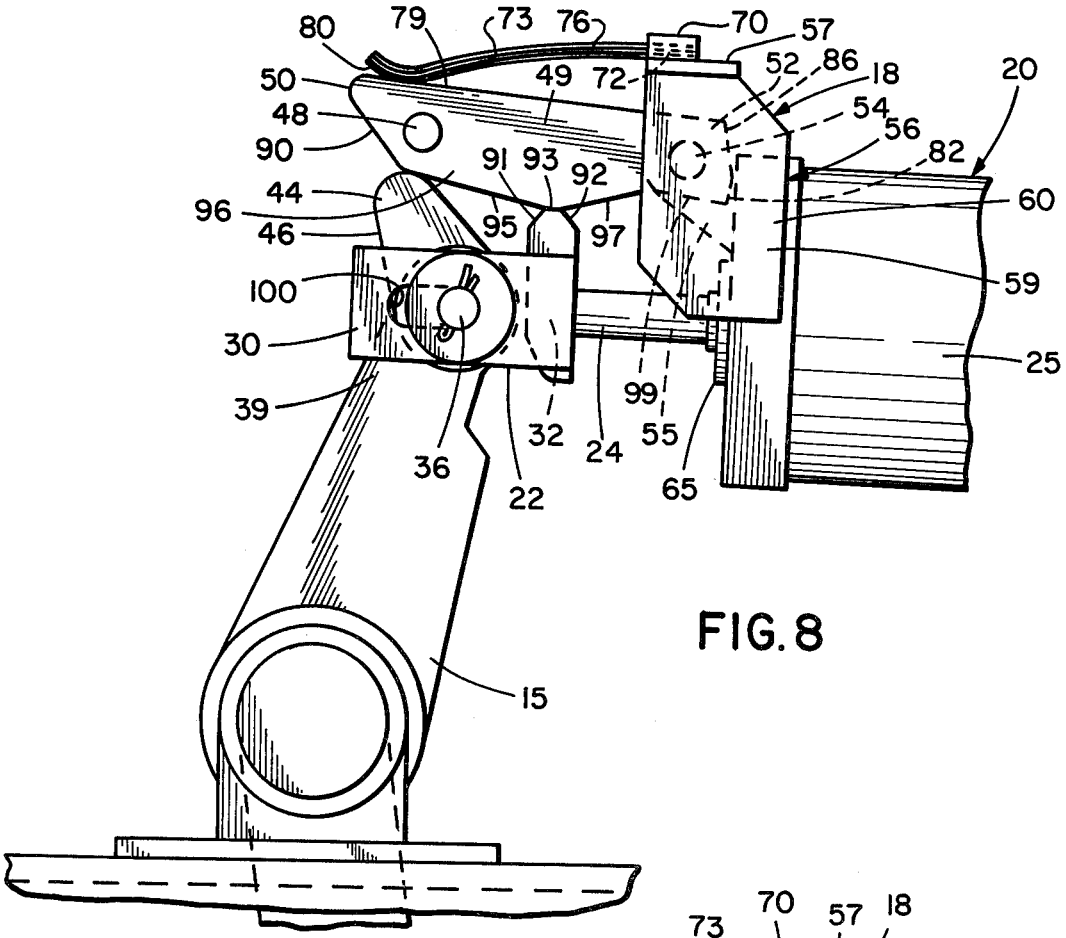
FIG. 8 is a side elevational view of the same structure as FIG. 7 showing a further position of the parts unlatched.

It will be observed that in the door open position, the operating lever is swung in a counterclockwise direction (see FIG. 9) and the locking ears 44 are tilted about the pin 36 to a position disposing the rear cam edge 105 substantially horizontally, edges 105 sloping upwardly and forwardly as the piston is retracted and clearing the locking pin as seen in FIG. 8 so as not to interfere with the action of the lifter sliding along the front cam profile 90 of the latch lever 50.

It will be noted that the rear edge 106 of the operating lever is notched at 107 to accommodate the lower tapered end 108 of the lifter which projects below the furcation.

It will now become readily apparent that a novel, positive locking securing mechanism has been provided which automatically locks and unlocks attendant to extension and retraction of the piston pursuant to pressurization of the cylinder in appropriate chambers as is well known.

The latch cannot be unlocked by forces acting from and through the operating lever.

Having described a perferred embodiment of the invention, other embodiments will be apparent to those skilled in the art which fall within the scope of the appended claims:

What is claimed is:

1. A railway car having operating cylinder means with a drive member operative upon a drive lever of a door opening mechanism for opening and closing of movable discharge doors, said car also including:

pivoted locking means adjacent said cylinder means for preventing operative movement of said lever mechanism, comprising:

a vertically swingable locking member having locking surface means, locking surface means on said drive lever adapted for locking engagement behind said locking surface means on said locking member in the locked position of said drive lever, said locking surface on said drive lever being generally planar, cooperative means on said drive member and locking member for lifting and lowering the latter attendant to extension and retraction respectively of said drive member for releasing and engaging said locking surface means, and said locking surface means on the driving lever being positioned essentially vertically in the locked position and spaced from the axis of pivotal connection between said drive member and lever and said surface means on the drive lever positioned to move to a position vertically overlapping said locking surface means on the pivoted locking means in consequence of said drive lever attempting to move in a door opening direction.

2. The invention according to claim 1, and said drive lever and drive member being pivotally connected on a generally horizontal axis, and said drive lever having an extension above said axis, and said locking surfaces on said drive lever being located on said extension and facing away from said cylinder means.

3. The invention according to claim 1, and said drive lever and drive member having a lost-motion pivotal connection about a horizontal axis and said locking member being cantilever hung from said cylinder for pivotal swinging movement about a horizontal axis, means for limiting downward pivotal movement of said locking member to a predetermined location, a lifter carried by said drive member, cam means on said locking member engageable with said lifter, said drive lever having means projecting above said axis and having said locking surfaces thereon and in the locking position preventing extension of said drive member, and means yieldably biasing said locking member to locking position.

4. The invention according to claim 3, and said yieldable means comprising a leaf spring in engagement with said locking member.

5. The invention according to claim 1, and said lever comprising a pair of ears extending upwardly therefrom in the locking position and thereat receiving said locking member therebetween said locking surface, means on the lever extending transversely of said drive member and in the locking position, being disposed between said locking surface means on the locking member and said cylinder.

6. The invention according to claim 5, and said locking member lifter carried by said drive member and cam means on said locking member engageable with said lifter adapted to lift said locking member and disengage said locking surface means attendant to extension of said drive member and to lower said locking member during retraction of the drive member.

7. The invention according to claim 6, and said locking member being superposed with respect to the drive member and elongated in the direction of movement of said drive member and, said cam means disposed on the lower edge of said locking member.

8. The invention according to claim 7, and a leaf spring elongated generally parallel with said locking member and said drive member, and said drive member comprising a piston rod having a lost motion pivotal connection with said driving lever on a substantially horizontal axis and said lever member having a locking projection extending lengthwise above said axis in the locked position and having said surface means thereon and in the unlocked and extended position of said piston said projection extending as a longitudinal extension of said piston clear of said locking member supported thereabove.

9. A locking device for a piston and cylinder and an actuating lever pivoted intermediate its ends to the piston on a transverse axis, said lever having first and second legs and said one leg at one side of said axis adapted for connection to a mechanism operable thereby, said device comprising:

mounting means on the cylinder, a latch pivoted at one end above the piston to said mounting means on an axis generally parallel with said transverse axis and having means at the other end providing a locking surface facing toward the cylinder, a generally planar locking surface on the second leg at the opposite side of said axis facing away from the cylinder in the locked position and engaging behind said cylinder facing surface on said latch, and means on said latch and piston for lifting said latch to a position disposing said surface thereon above said locking surface on the leg pursuant to extension of the piston for operating said lever and for lowering said latch upon said leg being located in loading position in consequence of and attendant to said piston retracting.

10. The invention according to claim 9, and spring means positioned above said locking member and reactive between the locking member and said anchor member for biasing the locking member to the locking position.

* * * * *